US005492287A

United States Patent [19]

Raudaskoski et al.

[11] Patent Number: 5,492,287

[45] Date of Patent: Feb. 20, 1996

[54] DRUM WINDER AND METHOD FOR WINDING A WEB

[75] Inventors: Vesa Raudaskoski, Järvenpää; Petteri Rinne, Kerava, both of Finland

[73] Assignee: Valmet Paper Machinery, Inc., Helsinki, Finland

[21] Appl. No.: 260,050

[22] Filed: Jun. 15, 1994

[30] Foreign Application Priority Data

Jun. 30, 1993 [FI] Finland ..... 933012

[51] Int. Cl.[6] ..... B65H 18/20

[52] U.S. Cl. ..... 242/541.4; 242/542

[58] Field of Search ..... 242/541.4, 542, 242/542.2, 542.3

[56] References Cited

U.S. PATENT DOCUMENTS

| | | | |
|---|---|---|---|
| 3,346,209 | 10/1967 | Cronin . | |
| 3,497,151 | 2/1970 | Voss et al. . | |
| 3,918,654 | 11/1975 | Okubo et al. | 242/542 |
| 4,171,106 | 10/1979 | Crouse | 242/542.2 |
| 4,738,407 | 4/1988 | Arrant | 242/542 |

*Primary Examiner*—John P. Darling

*Attorney, Agent, or Firm*—Steinberg, Raskin & Davidson

[57] ABSTRACT

A drum winder and method for winding a web, including winding drums for supporting a roll that is being formed and a pressurized gap formed by the winding drums and the roll being formed. The cutter well or a part of same has been formed as a sealed pressure chamber and is coupled to the gap in order to pressurize the gap.

18 Claims, 5 Drawing Sheets

DRUM WINDER AND METHOD FOR WINDING A WEB

BACKGROUND OF THE INVENTION

The present invention relates to a drum winder for winding a web, which comprises winding drums that support a roll that is being formed and a pressurized gap formed by the winding drums and by the roll that is being formed.

The present invention also relates to a method for winding a web in a drum winder in which the web is wound onto a roll supported by winding drums.

In drum winding, it is desirable to lower the linear nip loads produced by the weight of the growing roll, because otherwise the linear loads that act in the nips will become excessively high, causing defects in the roll.

With respect to the prior art, reference is made to the publications DE 1,047,001, DE 1,111,496, DE 3,618,955, and U.S. Pat. No. 3,497,151. In the devices described in these prior art references, it is known to pass a pressure into the gap formed by the roll that is being formed and by the winding drums, whereby a relief effect is applied to the roll that is formed. As a result of this effect, the linear loads in the nips cannot become excessively high. In order that the pressure should be retained in the gap formed by the roll and by the winding drums, it is known from the prior art to seal the gap from above and from below, respectively, by means of various sealing constructions. From the publication DE 1,047,001, it is known to move the upper roll-end sealing unit in an axial direction of the roll.

In addition, from U.S. Pat. No. 3,346,209, it is known to regulate the pressure present in the gap formed by the roll and the winding drums by moving the lower drum in a substantially vertical direction, i.e., up and down.

Even though by means of the prior art devices described above, considerable improvement in the winding of a web onto a roll is achieved, they involve certain drawbacks. For example, sealing of the gap formed by the roll that is formed and the winding drums is generally problematic. The pressure always leaks to some extent, which results in problems of dust formation. Owing to the leakage of the pressure, a very large quantity of air is needed to maintain the pressure, which air spreads into the working environment, for which reason the dust is readily separated from the web that is wound and spreads into the working environment.

Moreover, the prior art devices restrict or at least hamper some operations that are necessary in the roll formation. One of these operations is the roll change wherein when the roll that is being wound becomes complete, a new roll spool must be fed into the gap between the winding drums, the web that is wound must be cut off, and the end of the cut-off web must be attached to the new roll spool. Thus, during roll change operations, various actuators are needed, such as web holders, cutting means, devices for the feed of a new roll spool, etc.

OBJECTS AND SUMMARY OF THE INVENTION

Accordingly, it is an object of the present invention to provide an improvement over the prior art methods of drum winding and drum winders.

It is another object of the present invention to provide a drum winder, and method for drum winding a web, that have the same advantages as so-called pressure winders but in which the numerous drawbacks involved in the prior art devices are avoided.

The objects of the invention stated above, and others, are achieved in the drum winder in accordance with the invention by forming the cutter well or a part of the cutter well as a sealed pressure chamber in order to pressurize the gap situated between the winding drums and the roll that is being formed.

By means of the device in accordance with the present invention, a number of remarkable advantages are achieved compared with the prior art devices. In the invention, it has been realized to produce or apply a pressure in the gap formed by the winding drums and the roll that is being formed out of a pressure chamber, which is a sealed cutter well. The cutter well is generally made of concrete, steel, or equivalent and, as a rule, such a cutter well already exists for the paper machine and can usually withstand the necessary pressure. For example, in slitter winders, there is usually a well of varying size underneath the floor level, which well can usually be converted to a purposeful pressure chamber with little changes in the construction. In the interior of such a pressure chamber, almost all of the devices needed for the roll change operation, such as the web cutter, the spool feeder, the web threading device, the web holder, the web-end threading blower, etc., may be situated. As a result of this construction, in the device in accordance with the invention, no special constructional elements are required for the pressure chamber with respect to the equipment necessary for the roll change operation.

In the event of web breaks, the paper broke entering through the gap can be recovered under control into the cutter well. At the same time, the cutter well also collects a part of the winding dust. If necessary, it is also readily possible to arrange automatic cleaning of the cutter well, in which case the cutter well is emptied along a pipe system into a collecting container or pulper. The cutter well may also be provided with the devices necessary for producing the pressure which is applied in the gap, such as blowers, regulators, filters, in which case the piping, which is often awkward, can be omitted.

In another embodiment of the invention, as the pressure chamber, it is also possible to use a smaller sealing chamber constructed within the cutter well, in which case, in the event of web breaks, the paper broke entering through the gap can be recovered under control into the sealing chamber. At the same time, the sealing chamber also collects a part of the winding dust. If necessary, it is also readily possible to construct automatic cleaning of the sealing chamber, in which case the sealing chamber is emptied along a pipe system into a collecting container or pulper. The sealing chamber may also be provided with the devices necessary for producing the pressure in the gap, such as blowers, regulators, filters, in which case the piping, which is often awkward, can be omitted.

In the method in accordance with the invention, a web is wound onto a roll supported by winding drums and arranged in proximity to a cutter well. The winding drums and the roll form a pressurized gap therebetween. A sealed pressure chamber is formed in the cutter well, the pressure chamber is coupled to the gap, and a pressure is produced or applied in the pressure chamber to pressurized the gap.

In a preferred embodiment, spaces between the pressure chamber and cylinder faces of the winding drums, ends of the winding drums, and ends of the gap are sealed to maximize the application of pressure into the gap. The pressure chamber may be formed in only a part of the cutter well, in which case, the pressure chamber is supported in the cutter well on a support beam, and can be moved along the support beam. The web may be passed over a reversing roll before the web is wound onto the roll being formed and after the web runs over one of the winding drums.

The invention will be described in detail with reference to some preferred embodiments of the invention illustrated in the figures in the drawing. The invention is, however, not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
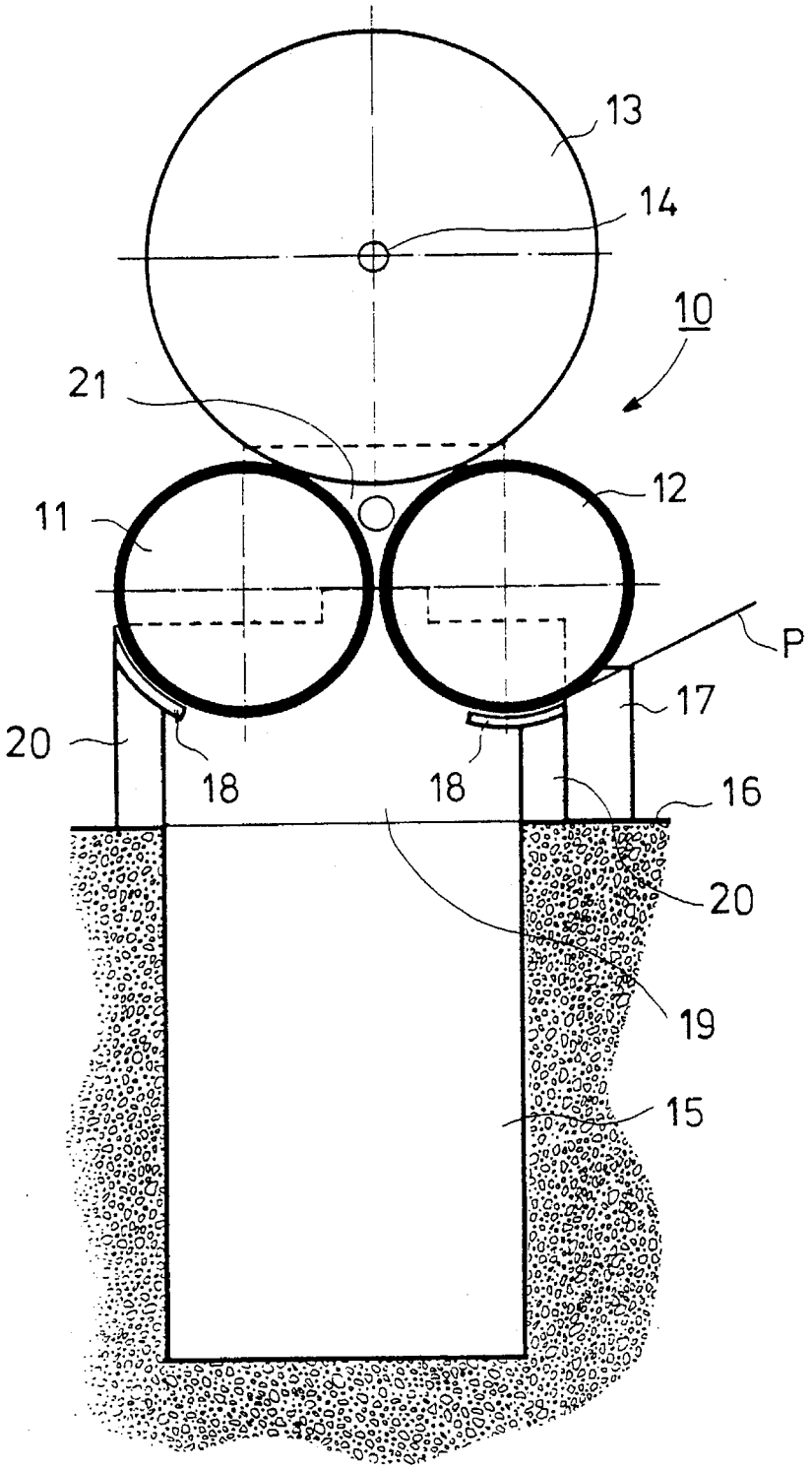
FIG. 1 is an end view of a preferred embodiment of a drum winder in accordance with the invention and used in the method in accordance with the invention.

Referring to the drawings, wherein the same reference numerals refer to the same elements, in FIG. 1, a drum winder in accordance with the invention is denoted generally by reference numeral 10. Winding drums are denoted by reference numerals 11 and 12, and a roll that is being formed as it is supported by the winding drums is denoted by reference numeral 13. The spool lock of the roll spool is denoted by reference numeral 14. A web P is produced in the paper machine and wound onto roll 13. The drum winder 10 described above is a typical and conventional prior art drum winder.

In accordance with the invention, a pressure is applied or otherwise produced in a gap formed between the winding drums 11 and 12 and the roll 13 that is being formed and the pressure is obtained from a pressure chamber 15 which consists of the sealed cutter well. Generally, such a cutter well 15 already exists for a drum winder, and the cutter well 15 withstands the necessary pressure. The cutter well 15 is generally made of concrete, steel, or equivalent material. For example, slitter winders usually comprise a well of varying size underneath a plane of the floor 16, and the well can usually be converted to a suitable pressure chamber 15 with little changes in construction. In the interior of such a pressure chamber 15, almost all the devices needed for the roll change operation, such as the web cutter, the spool feeder, and the web P threading device, may be situated. Thus, the pressure chamber 15 in accordance with the invention does not require any special constructional details with respect to the equipment related to the roll change operation.

In the embodiment shown in FIGS. 1 and 2, the gap formed by the winding drums 11,12 and the roll 13 that is being formed is sealed advantageously as follows. The pressure chamber 15 is sealed in the area between the pressure chamber 15 and the winding drums 11,12 by means of seal units 18 that seal the cylinder faces of the winding drums 11,12. In addition, a lower end seal unit 19 and seal units 20 are needed, which form a sealing part that rises from the floor plane 16. In this embodiment, the sealing at the winding drum 12 is arranged in connection with a foundation 17 with respect to the seal units 18,19 and 20. The seal units 20 rise from the floor plane 16 and may be of the same uniform construction as the floor plane 16 i.e., are integrally connected to one another, to provide a very efficient seal. In some embodiments, the winding drums 11 and 12 may be placed at a low level in relation to the floor plane 16 that the seal units 20 are not needed at all. An upper end seal unit is also provided and is denoted by reference numeral 21. The upper end seal unit 21 may be any sealing device in itself known. The seal unit 18 may be any known mode of sealing whatsoever, such as, for example, a doctor, a rubber lip, a felt, a narrow gap, etc.

Figure 2:
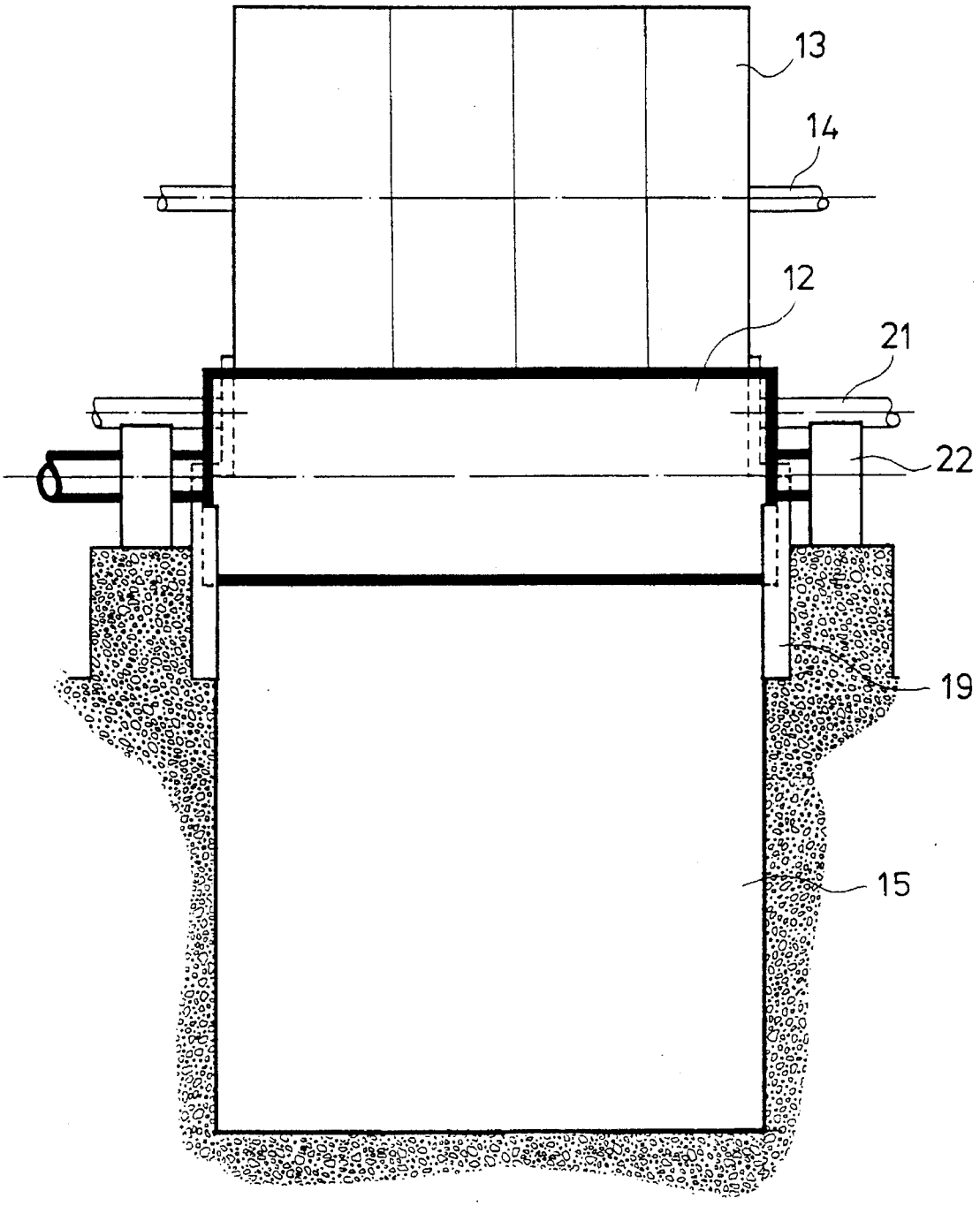
FIG. 2 is a front view of the embodiment as shown in FIG. 1.

FIG. 2 shows the lower end seal unit 19 which seals the lower portion of the winding drums and the upper end seal unit 21 which seals the end portion of the gap between the winding drums and the roll 13. However, FIG. 2 does not show the seal units 20 or 18. The winding drum 12 is provided with a bearing housing 22.

Figure 3:
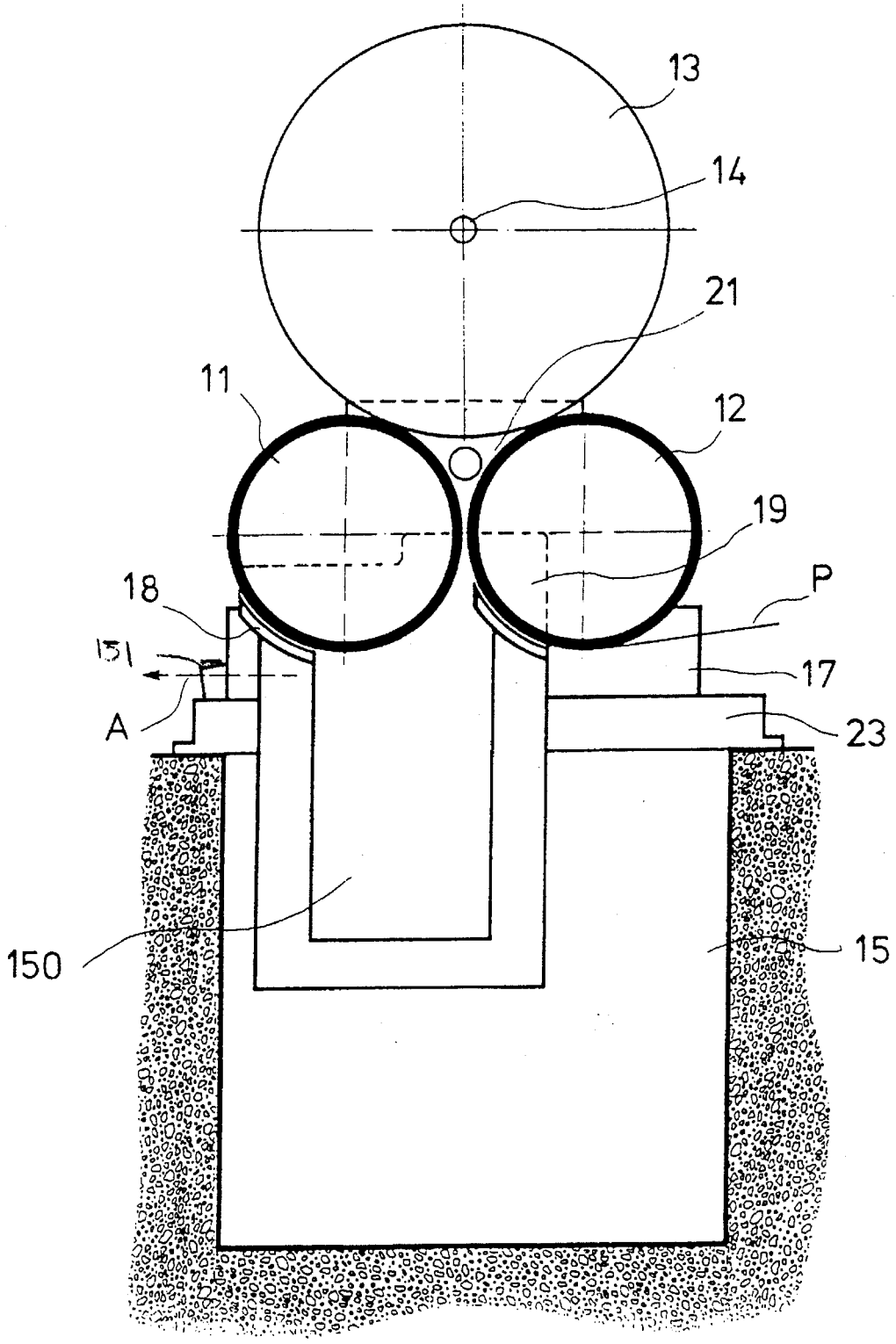
FIG. 3 is an end view of a second preferred embodiment of a drum winder in accordance with the invention and used in the method in accordance with the invention.
Figure 4:
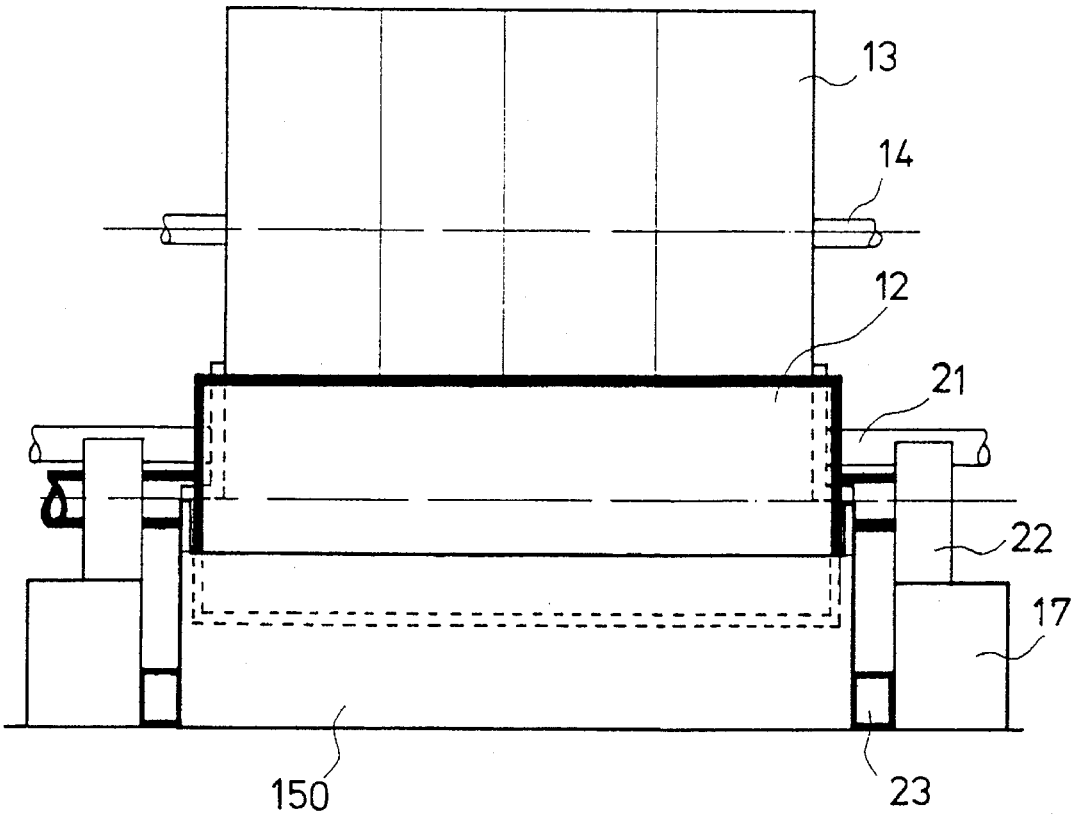
FIG. 4 is a front view of the embodiment as shown in FIG. 3.

The embodiment shown in FIGS. 3 and 4 differs from the embodiment of FIGS. 1 and 2 with respect to that fact that the entire cutter well 15 has not been formed into a pressure chamber. Rather, a smaller pressure chamber or sealing chamber 150 has been formed in the cutter well 15. In this embodiment, the lower end seal unit 19 is indicated at the end of the winding drum by means of the dashed line. The lower sealing and so also the upper sealing can also be sealed at the cylinder face of the winding drum by means of the seal units 18. Also in this embodiment, the seal unit 18 may be any known mode of sealing whatsoever, such as, for example, a narrow gap, a felt, a doctor, a rubber lip, etc. A support beam 23 is provided for supporting the pressure chamber, i.e., of the sealing chamber 150, and may be mounted on the foundation as shown.

The pressure chamber, i.e., the sealing chamber 150, is illustrated in a fixed position. If necessary, the sealing chamber 150 may be constructed so that it is movable via means 151 and moves forwards in the direction indicated by the dashed line in the direction of the arrow A along the face of the support beam 23. In this case, a gap is formed between the winding drums 11,12 and the sealing faces for threading the web P and cleaning the drum winder 10, when desired. If the sealing chamber 150 is fixed, as shown in FIGS. 3 and 4, the gap can be formed by moving the winding drums 11,12 and/or the seal units or their parts. By means of different shapes and locations of the seal units 18,19,20 and 21, the desired direction of movement can be achieved for the winding drums 11,12.

The embodiment shown in FIGS. 3 and 4 is advantageous in the sense that, in the event of a break in the web P, the paper broke entering through the gap can be recovered under control into the sealing chamber 150. At the same time, the sealing chamber 150 also collects a part of the winding dust. From the interior of the sealing chamber 150, any impurities can be collected and removed in a controlled manner. If necessary, it is also readily possible to construct automatic cleaning of sealing chamber 150, in which case the sealing chamber 150 is emptied along a pipe system into a collecting container or pulper.

The sealing chamber 150 may also be provided with devices needed for producing the pressure which is then passed into the gap, such as blowers, regulators, filters, in which case the piping, which is often awkward, can be omitted. The sealing chamber 150 may be supplemented with various accessories, such as a web threading device, a web cutter, a web holder, a web threading blower, etc.

Even though the embodiment shown in FIGS. 3 and 4 is, in principle, similar to the embodiment shown in FIGS. 1 and 2, the sealing chamber 150 as shown in FIGS. 3 and 4 is more suitable for use with existing slitter winders, because existing cutter wells 15 often contain pipings and holes, which are difficult to seal.

Figure 5:
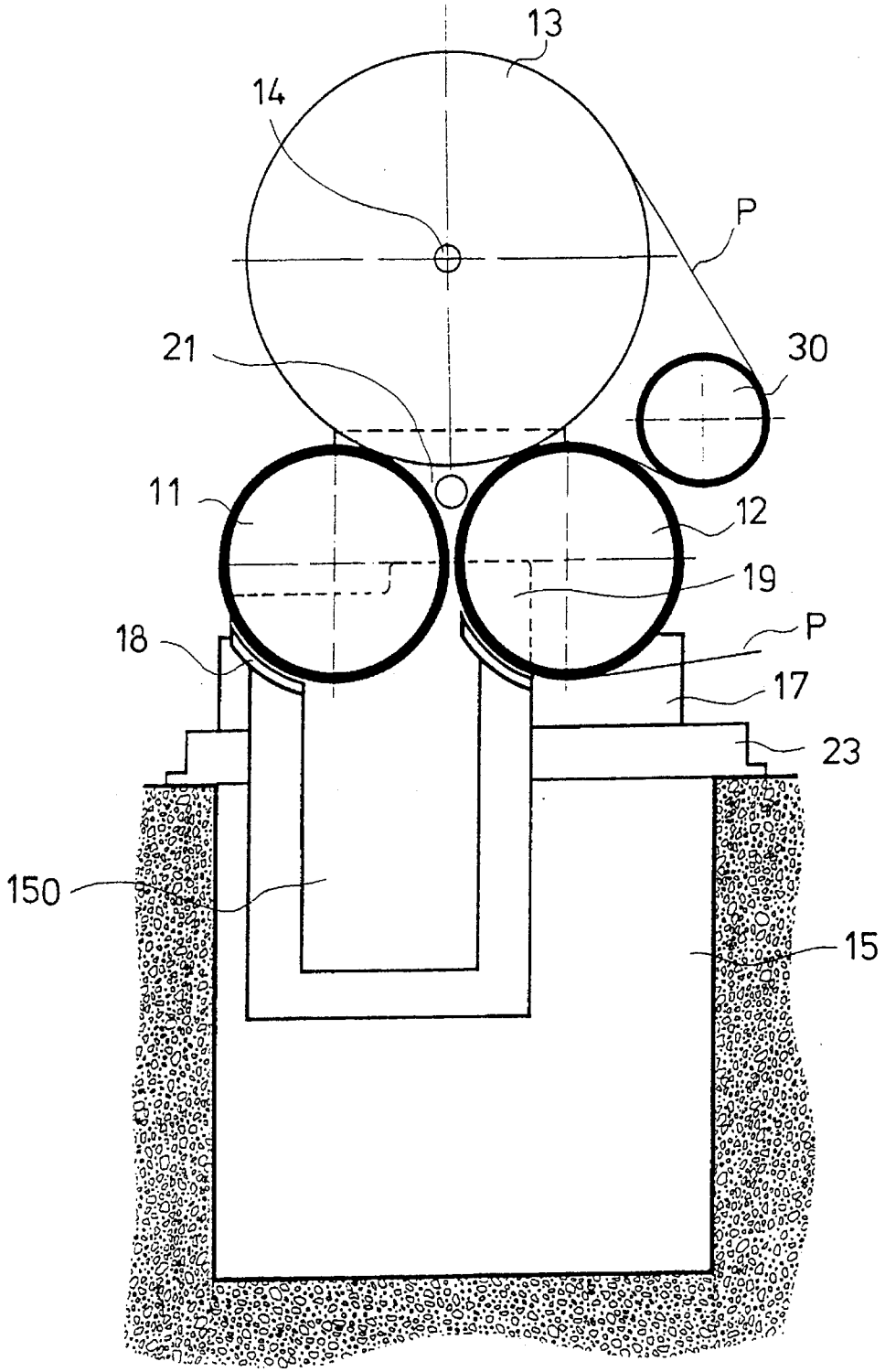
FIG. 5 is an end view of a third preferred embodiment of a drum winder in accordance with the invention and used in the method in accordance with the invention.

The embodiment shown in FIG. 5 is in most respects similar to the embodiment shown in FIGS. 3 and 4. However, in the embodiment shown in FIG. 5, the web P is passed from the nip formed between the roll being formed 13 and the winding drum 12 over a reversing roll 30 and then is wound onto the roll. It should be noted that, when the web P is wound, a bag formation, i.e., air bags or pockets, may occur in the surface layer of the roll 13, in particular with web materials that are not substantially air-permeable, because the pressurized air present in the gap formed by the winding drums 11 and 12 is placed underneath the surface layer of the roll that is being formed and produces detrimental formation of air bags. In the embodiment shown in FIG. 5, this phenomenon has been substantially eliminated by the reversing roll 30.

In the embodiments shown in FIGS. 1–5, the web P is shown as being passed between the winding drums 11 and 12. It is obvious though that the web P can also be passed equally well either from above or from the front as is used in prior art devices. The mode of introduction of the web P only affects the location of the reversing roll 30.

The examples provided above are not meant to be exclusive. Many other variations of the present invention would be obvious to those skilled in the art, and are contemplated to be within the scope of the appended claims.

We claim:

1. Drum winder situated over a cutter well, said drum winder including winding drums for supporting a roll being formed as a web is wound thereon and a pressurized gap formed by said winding drums and said roll, the improvement comprising means for forming a sealed pressure chamber in said cutter well communicating with said gap, means for pressurizing said pressure chamber such that said gap communicating therewith is pressurized, said winding drums being positioned above a plane of a floor on which the drum winder is situated, and first sealing means for sealing spaces between said floor and said winding drums, said first sealing means and said floor being integrally connected to one another.

2. The drum winder of claim 1, wherein said winding drums comprise cylinder faces, further comprising second sealing means coupled to said first sealing means for sealing spaces between said pressure chamber and said cylinder faces of said winding drums.

3. The drum winder of claim 2, wherein said second sealing means comprise a doctor, a felt, rubber lip or a narrow gap.

4. The drum winder of claim 1, further comprising an upper end seal unit for sealing ends of said gap.

5. The drum winder of claim 1, further comprising a lower end seal unit for sealing said pressure chamber at ends of said winding drums.

6. The drum winder of claim 1, further comprising a reversing roll over which the web is passed before being wound onto said roll being formed and after the web runs over one of said winding drums.

7. The drum winder of claim 1, further comprising means for forming said pressure chamber in only a part of the cutter well.

8. The drum winder of claim 7, further comprising a support beam for supporting said pressure chamber.

9. The drum winder of claim 8, further comprising displacement means for moving said pressure chamber along said support beam.

10. The drum winder of claim 1, wherein said winding drums comprise cylinder faces, further comprising second sealing means for sealing spaces between said pressure chamber and said cylinder faces of said winding drums, a lower end seal unit for sealing said pressure chamber at ends of said winding drums, and an upper end seal unit for sealing ends of said gap, said second sealing means, said lower end seal unit and said upper end seal unit being displaceable to form a space between said winding drums and said second sealing means.

11. The drum winder of claim 1, wherein said winding drums comprise cylinder faces and are displaceable to form a space between said winding drums and said first sealing means.

12. The drum winder of claim 1, wherein said pressure chamber occupies all of said cutter well.

13. Drum winder situated over a cutter well, said drum winder including winding drums for supporting a roll being formed as a web is wound thereon and a pressurized gap formed by said winding drums and said roll, the improvement comprising means for forming a sealed pressure chamber in only a part of said cutter well and in communication with said gap, means for pressurizing said pressure chamber such that said gap communicating therewith is pressurized, a support beam for supporting said pressure chamber, and displacement means for moving said pressure chamber along said support beam.

14. Drum winder situated over a cutter well, said drum winder including winding drums for supporting a roll being formed as a web is wound thereon and a pressurized gap formed by said winding drums and said roll, each of said winding drums comprising a cylinder face, the improvement comprising means for forming a sealed pressure chamber in said cutter well communicating with said gap, means for pressurizing said pressure chamber such that said gap communicating therewith is pressurized, sealing means for sealing spaces between said pressure chamber and said cylinder faces of said winding drums, a lower end seal unit for sealing said pressure chamber at ends of said winding drums, and an upper end seal unit for sealing ends of said gap, said sealing means, said lower end seal unit and said upper end seal unit or parts thereof being displaceable to form a space between said winding drums and said sealing means.

15. Method for pressurizing a gap in a drum winder defined by winding drums and a roll supported by said winding drums and onto which a web is being wound, said drum winder being situated over a cutter well, comprising the steps of:

forming a sealed pressure chamber in only a part of said cutter well, coupling said pressure chamber to said gap, providing a pressure in said pressure chamber such that said gap coupled therewith is pressurized, supporting said pressure chamber in said cutter well on a support beam, and moving said pressure chamber along said support beam.

16. The method of claim 15, further comprising the steps of: sealing spaces between said pressure chamber and cylinder faces of said winding drums, sealing said pressure chamber at ends of said winding drums, and sealing ends of said gap.

17. The method of claim 15, further comprising the step of passing the web over a reversing roll before the web is wound onto the roll being formed and after the web runs over one of said winding drums.

18. The method of claim 15, further comprising the step of utilizing all of said cutter well as said pressure chamber.

* * * * *